US006864223B2

(12) United States Patent
Smith et al.

(10) Patent No.: US 6,864,223 B2
(45) Date of Patent: Mar. 8, 2005

(54) THICKENED FABRIC CONDITIONERS

(75) Inventors: Daniel Smith, Sayreville, NJ (US); Isabelle Salesses, Liege (BE); Jacques Dewez, Battice (BE); Ericka Breuer, Grace-Hollogne (BE); Guy Broze, Grace-Hollogne (BE); Marija Heibel, Highland Park, NJ (US); Amjad Farooq, Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 275 days.

(21) Appl. No.: 10/006,337

(22) Filed: Dec. 3, 2001

(65) Prior Publication Data

US 2002/0132749 A1 Sep. 19, 2002

Related U.S. Application Data

(63) Continuation-in-part of application No. 09/749,183, filed on Dec. 27, 2000, now abandoned.

(51) Int. Cl.[7] ..... C11D 3/37; C11D 3/50
(52) U.S. Cl. ..... 510/475
(58) Field of Search ..... 510/522, 527, 510/475

(56) References Cited

U.S. PATENT DOCUMENTS 4,806,345 A * 2/1989 Bhattacharyya ..... 424/70
5,100,660 A * 3/1992 Hawe et al. ..... 424/78.35
5,989,536 A * 11/1999 Deckner et al. ..... 424/78.05

FOREIGN PATENT DOCUMENTS

DE 4313085 A1 * 10/1994
WO WO 90/12862 * 11/1990

* cited by examiner

*Primary Examiner*—John R. Hardee
(74) *Attorney, Agent, or Firm*—Bernard Lieberman

(57) ABSTRACT

The present invention relates to thickened fabric conditioners, which fabric conditioners contain a particular polymeric thickener, which is obtained by polymerizing from 5 to 100 mole percent of a cationic vinyl addition monomer, from 0 to 95 mole percent of acrylamide, and from 70 to 300 ppm of a difunctional vinyl addition monomer cross-linking agent. As compared to such compositions comprising a similar product but obtained from a polymerization reaction using between 5 and 45 ppm cross-linking agent considerable advantages are obtained. Especially, the delivery of fragrance present in the softening composition is more efficiently carried over to the fabrics to be treated.

7 Claims, 17 Drawing Sheets

DSC of BP Polymer

DSC of SNF Polymer

THICKENED FABRIC CONDITIONERS

This application is a continuation-in-part of prior U.S. application Ser. No. 09/749,183 now ABN, filed Dec. 27, 2000, the disclosure of which is incorporated herein.

TECHNICAL FIELD OF THE INVENTION

The present invention relates to fabric conditioning formulations, and especially to rinse-cycle fabric conditioners, comprising at least one fabric softener, and at least one thickening agent for water-based compositions. More specifically, these fabric conditioning formulations also contain at least one fragrance.

BACKGROUND OF THE INVENTION

Conventionally, most domestic liquid detergents and liquid fabric conditioning or fabric softener compositions make use of thickening properties of surfactant ingredients or added salts to come to a desired rheology. The last decade, however, there is a growing need to come to formulations that are physically and rheologically stable at ambient conditions for at least a month or so. Such formulations generally contain specific thickeners in amounts leading to the desired viscosities and giving suitable stabilities.

WO 90/12862 (BP Chemicals Ltd.) discloses aqueous based fabric conditioning formulations comprising a water dispersible cationic softener and as a thickener a cross-linked cationic polymer that is derivable from a water soluble cationic ethylenically unsaturated monomer or blend of monomers, which is cross-linked by 5 to 45 ppm of a cross-linking agent comprising polyethylenic functions. More in particular, these cationic polymers are formed from monoethylenically unsaturated monomer that is either a water soluble cationic monomer or is a cationic blend of monomers that may consist of cationic monomers alone or may consist of a mixture of cationic and non-ionic monomers in the presence of a cross-linking agent. Polymeric thickeners which are in accordance with this prior art publication are referred to herein in the description and Examples for comparative purposes; they are usually referred to as "BP polymer".

The preferred amount of cross-linking agent used in the polymerization is said to be selected in such a way that the Ionic Regain reaches a peak or plateau and preferably is between 10 and 25 ppm.

A commercial product covered by said WO 90/12862 is a cross-linked cationic copolymer of about 20% acrylamide and about 80% of trimethylammonioethylmethacrylate salt cross-linked with 5–45 ppm methylene bis acrylamide (MBA). The cross-linked polymer is supplied in a liquid form as an inverse emulsion in mineral oil. It is referred to in the present description as the "BP polymer".

In EP-A-0 799 887 liquid fabric softening compositions are described which are said to exhibit an excellent viscosity and phase stability as well as softness performance, which compositions comprise: (a) 0.01–10 wt. % of a fabric softener component, (b) at least 0.001% of a thickening agent selected from the group of (i) associative polymers having a hydrophilic backbone and at least two hydrophobic groups per molecule attached to the hydrophilic backbone, (ii) the cross-linked cationic polymers described in the above-mentioned WO 90/12862, cross-linked by 5–45 ppm of cross-linking agent comprising polyethylenic functions and (iii) mixtures of (i) and (ii), and (c) a component capable of sequestering metal ions.

In Research Disclosure page 136, no. 429116 of January 2000, SNF Floerger has described cationic polymeric thickeners that are useful in fabric softeners. The thickeners described are branched and/or cross-linked cationic polymers formed from monoethylenically unsaturated monomers being either water soluble cationic monomers or blends of cationic monomers that may consist of cationic monomers alone or may comprise a mixture from 50–100% cationic monomer or blend thereof and from 0–50% of non-ionic monomers in the presence of a cross-linking agent in an amount of 60 to 3000 ppm and of chain transfer agent in an amount of between 10 and 2000 ppm. The cationic monomers are selected from the group of dimethylaminopropyl methacrylamide, dimethylaminopropylacrylamide, diallylamine, methyldiallylamine, dialkylaminoalkylacrylate and methacrylate, dialkylaminoalkyl acrylamide or methacrylamide, derivatives of the previously mentioned monomers or quaternary or acid salts thereof. Suitable non-ionic monomers are selected from the group consisting of acrylamide, methacrylamide, N-alkyl acrylamide, N-vinyl pyrrolidone, vinylacetate, vinyl alcohol, acrylate esters, allyl alcohol, and derivatives thereof. The cross-linking agents are methylene bisacrylamide and all diethylenically unsaturated compounds.

U.S. Pat. No. 4,806,345 teaches personal care compositions which have as a thickening agent a cross-linked cationic vinyl addition polymer. The personal care compositions include water, at least one cosmetically-active agent and such a thickening agent that is preferably derived from the polymerization of a cationic vinyl addition monomer, acrylamide, and 50–500 ppm of a difunctional vinyl addition monomer for cross-linking purposes. Preferred embodiments described in U.S. Pat. No. 4,806,345 only differ from the preferred products of WO 90/12862 in that more (of the same) cross-linking agent is used in the polymerization reaction.

OBJECTS OF THE INVENTION

It is a first object of the present invention to provide fabric conditioning or softener compositions that are more stable than the softener compositions described in WO 90/12862 and EP-A-0 799 887.

It is a second object to develop fabric softener compositions that are easier and quicker to prepare.

It is a third object of the present invention to provide fabric softener compositions that are less sensitive to differences in water hardness, even without the necessity of using a co-softener, so that one and the same commercial composition could be marketed throughout the entire world.

It is a further object to come to fabric conditioner compositions that provide better fragrance retaining capacities. In laundry products such as fabric softeners the perfume additives make laundry compositions more aesthetically pleasing to the consumers. Besides the point of purchase perception, another objective of the use of perfume additives is to impart a pleasant and longer lasting fragrance to fabrics that are treated therewith. However, the amount of perfume carry-over is marginal due to much of it being lost down the drain during the wash. Once deposited on the fabric surface, there is a need for a controlled release of the fragrance over a long period of time. So, there is a need to deliver perfume onto fabrics more effectively, so that it can be released for a longer period of time.

Other objectives and advantages of the compositions of the present invention will follow from the detailed description herein-below.

SUMMARY OF THE INVENTION

In accordance with the present invention, there are provided fabric softening compositions which are based on the use of a water-soluble cross-linked cationic vinyl polymer which is cross-linked by a cross-linking agent comprised of from about 70 to 300 ppm of a difunctional vinyl addition monomer cross-linking agent.

A first fabric softening composition in accordance with the invention comprises:

(a) from 0.01% to 35%, by weight, of a cationic softener;

(b) at least 0.001%, by weight, of a water soluble cross-linked cationic polymer derived from the polymerization of from 5 to 100 mole percent of a cationic vinyl addition monomer, from 0 to 95 mole percent of acrylamide, and from 70 to 300 ppm of a difunctional vinyl addition monomer cross-linking agent; and (c) a perfume.

A preferred cationic softener is an esterquat softener having the following structural formula:

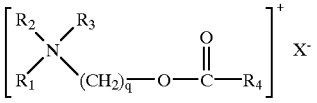

wherein R4 represents an aliphatic hydrocarbon group having from 8 to 22 carbon atoms, $R_2$ and $R_3$ represent $(CH_2)_s$-$R_5$ where $R_5$ represents an alkoxy carbonyl group containing from 8 to 22 carbon atoms, benzyl, phenyl, (C1–C4)-alkyl substituted phenyl, OH or H; R1 represents $(CH_2)_t$ $R_6$ where $R_6$ represents benzyl, phenyl, (C1–C4)-alkyl substituted phenyl, OH or H; q, s, and t, each independently, represent an integer from 1 to 3; and $X^-$ is a softener compatible anion.

The term "perfume" or "fragrance" as used herein refers to odoriferous materials which are able to provide a pleasing fragrance to fabrics, and encompasses conventional materials commonly used in detergent compositions to counteract a malodor in such compositions and/or provide a pleasing fragrance thereto. The perfumes are preferably in the liquid state at ambient temperature, although solid perfumes are also useful. Included among the perfumes contemplated for use herein are materials such as aldehydes, ketones, esters and the like which are conventionally employed to impart a pleasing fragrance to liquid and granular deterent compositions. Naturally ocurring plant and animal oils are also commonly used as components of perfumes. Accordingly, the perfumes useful for the present invention may have relatively simple compositions or may comprise complex mixtures of natural and synthetic chemical components, all of which are intended to provide a pleasant odor or fragrance when applied to fabrics. The perfumes used in detergent compositions are generally selected to meet normal requirements of odor, stability, price and commercial availability. The term "fragrance" is often used herein to signify a perfume itself, rather than the aroma imparted by such perfume.

Another fabric softening composition in accordance with the invention comprises:

(a) from 0.01% to 35%, by weight, of a cationic softener comprising a biodegradable fatty ester quaternary ammonium compound having the formula:

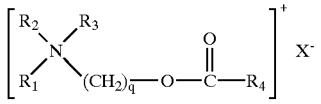

wherein $R_1$ is $C_1$–$C_4$ alkyl;

$R_2$ and $R_3$ are β-$C_8$-$C_{22}$-acyloxy ethyl or β-hydroxy ethyl;

R4 is an aliphatic hydrocarbon group having from 8 to 22 carbon atoms;

q is an integer from 1 to 3; and $X^-$ is a softener compatible anion;

(b) at least 0.001% of a water-soluble cross-linked cationic polymer derived from the polymerization of from 5 to 100 mole percent of a cationic vinyl addition monomer, from 0 to 95 mole percent of acrylamide, and from 70 to 300 ppm of a difunctional vinyl addition monomer cross-linking agent; and (c) at least 0.001% of a chelating compound capable of chelating metal ions and selected from the group consisting of amino carboxylic acid compounds, organo aminophosphonic acid compounds and mixtures thereof.

The present invention is predicated on several discoveries attendant to the use of the above-described cross-linked cationic polymer in fabric softening compositions:

(1) the significantly improved perfume delivery to fabrics which occurs when using the above-described fabric softening composition containing the aforementioned cross-linked cationic polymer and a perfume as compared to the use of an identical softening composition but in the absence of said cationic polymer; and (2) the signifcantly enhanced stability of a fabric softening composition as described above containing the defined esterquat softener and the defined cross-linked cationic polymer in the presence of a chelating compound as compared to an identical softening composition with chelating compound but which contains a cross-linked cationic polymeric thickener of the prior art which is different from that claimed and described herein.

DETAILED DESCRIPTION OF THE INVENTION

Figure 1:
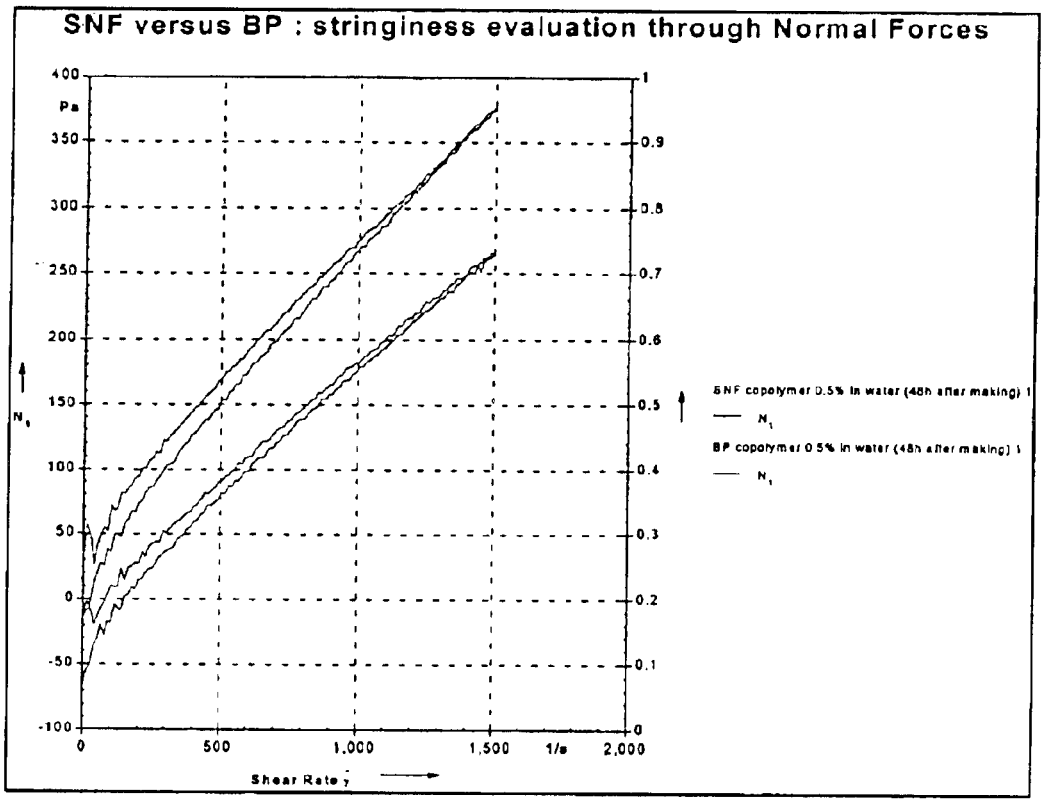
FIG. 1 describes stringiness versus shear rate ($s^{-1}$) for the BP Polymer and SNF Polymer.

The thickening polymer used in the compositions of the present invention is a cross-linked cationic vinyl polymer which is cross-linked using a cross-linking agent of a difunctional vinyl addition monomer at a level of from 70 to 300 ppm, preferably from about 75 to 200 ppm, and most preferably of from about 80 to 150 ppm. These polymers are further described in U.S. Pat. No. 4,806,345 and the above-identified Research Disclosure, which documents are both incorporated herein under reference.

Generally, such polymers are prepared as water-in-oil emulsions, wherein the cross-linked polymers are dispersed in mineral oil, which may contain surfactants. During finished product making, in contact with the water phase, the emulsion inverts, allowing the water soluble polymer to swell.

The most preferred thickener for use in the present invention is a cross-linked copolymer of a quaternary ammonium acrylate or methacrylate in combination with an acrylamide comonomer.

When compared with a corresponding thickener (same ratio of the same comonomers; same cross-linking agent) that is prepared while using 5–45 ppm cross-linking agent in the polymerization, the thickener required in the present invention delivers—under similar conditions—a finished product which has a prolonged physical stability (no separation, limited viscosity change), and which disperses better in water. More in particular, it was found that the thickener based on 5–45 ppm cross-linking agent exhibits instabilities upon long term storage while varying process and formula composition, which problems are, at least partly, overcome while using the amount of cross-linking agent required by the present invention. In addition, as compared to the compositions of the present invention, the compositions containing the copolymer cross-linked with 5–45 ppm cross-linking agent are found to be more sensitive to shear and unstable in presence of high level of electrolyte.

The thickener required in accordance with the present invention provides fabric softening compositions showing long term stability upon storage and allows the presence of relatively high levels of electrolytes without affecting the composition stability. Besides, the fabric softening compositions remain stable when shear is applied thereto.

The chelating compounds of the invention are capable of chelating metal ions and are present at a level of at least 0.001%, by weight, of the fabric softening composition, preferably from about 0.001% (10 ppm) to 0.5%, and more preferably from about 0.005% to 0.25%, by weight. The chelating compounds which are acidic in nature may be present either in the acidic form or as a complex/salt with a suitable counter cation such as an alkali or alkaline earth metal ion, ammonium or substituted ammonium ion or any mixtures thereof.

The chelating compounds are selected from among amino carboxylic acid compounds and organo aminophosphonic acid compounds, and mixtures of same. Suitable amino carboxylic acid compounds include: ethylenediamine tetraacetic acid (EDTA); N-hydroxyethylenediamine triacetic acid; nitrilotriacetic acid (NTA); and diethylenetriamine pentaacetic acid (DEPTA).

Suitable organo aminophosphonic acid compounds include: ethylenediamine tetrakis (methylenephosphonic acid); 1-hydroxyethane 1,1-diphosphonic acid (HEDP); and aminotri (methylenephosphonic acid).

Softener formulas using the thickener in accordance with the present invention are in addition less stringy than similar formulas, wherein the thickener as described in WO 90/12862 is present.

Furthermore, there are also manufacturing advantages associated to the thickener obtained in a polymerization reaction using 70–300 ppm, preferably 75–200 ppm, most preferably 80–150 ppm cross-linking agent, which manufacturing advantages encompass that the structure of the softener composition builds much faster; the viscosity of the softener formula of the invention develops immediately after making. In addition, the softening compositions disperse easier in water.

The use of the thickener obtained in a polymerization reaction using 70–250 ppm, and preferably 80–150 ppm cross-linking agent, provides a very valuable benefit for manufacturing, as the time required for the polymer to build the structure is much shorter than with the polymeric thickener based on 5–45 ppm cross-linking agent. This represents also additional consumer's benefits, as it improves the ease of softener pouring but also the physical energy required to disperse the finished product in water during hand wash practices.

More in detail, the polymeric thickeners used in accordance with the present invention have a faster swelling kinetic in water (3 min instead of 15 min for polymeric thickeners described in BP's WO 90/12862) as well as in aqueous based fabric softening composition (0 min after making instead of 30 to 60 min for the BP product) improving the manufacturing control of quality for process and products.

The swelling kinetics are, moreover, independent from the fabric softening composition (actives level, emulsifier level) and from the process conditions (equipment, shear).

Furthermore, advantages are obtained in the overall performances in a fabric softening composition of the present invention versus a similar composition including the BP polymer. More particular, a higher overall phase stability upon aging is obtained; there is a lower sensitivity to electrolytes; there is a lower sensitivity to shear; and there is a higher dispersibility of the finished product in water.

In a very important aspect of the present invention, it was found that the compositions of the present invention significantly improve the fragrance deposition on fabrics, especially under hard water conditions (washing conditions in Europe). In this light, it is noted that the present inventors have recently found that under US washing conditions (relatively low water hardness) the polymeric thickener described in WO 90/12862 improves fragrance delivery; yet the composition containing this thickener does not perform well in delivering fragrance under European washing conditions (higher water hardness).

PREFERRED EMBODIMENTS

In the compositions of the present invention various types of softeners can be used. The softeners can be of the category of cationic, nonionic, and anionic surfactants. In addition, other conventional ingredients for fabric softening and conditioning compositions, such as clays, silicones, fatty alcohols, fatty esters and so on, may be present.

Preferably cationic softeners are present, and especially preferred are softeners such as esterquats, imidazolinium quats, difatty diamido ammonium methyl sulfate, and ditallow dimethyl anunonium chloride. Suitable cationic softeners are described in U.S. Pat. Nos. 5,939,377, 6,020,304, 4,830,771, 5,501,806, and 4,767,547, all of which are incorporated herein by reference for this reason.

The most preferred softener for our invention is the one produced by reacting two moles of fatty acid methyl ester with one mole of triethanolamine followed by quaternization with dimethyl sulfate (further details on this preparation method are disclosed in U.S. Pat. No. 3,915,867). The reaction products are 50% diesterquat (a) material, 20% monoester (b) and 30% triester (c):

FIG. 1. Synthesis of Triethanolamine Esterquat

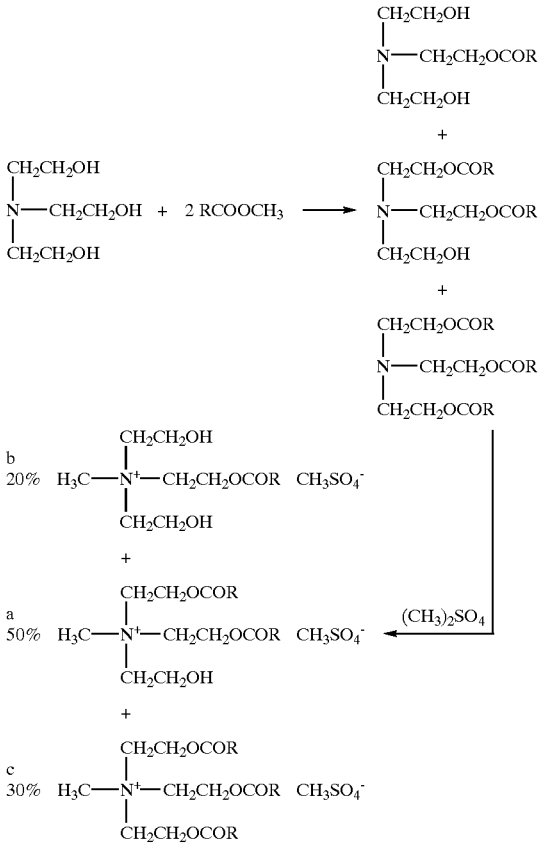

In the present specification, the above reaction product mixture of triethanolamine esterquat is often referred to simply as esterquat. It is commercially available from, e.g., Kao Corp. as Tetranyl AT1-75™.

In esterquat softener systems, upon dilution in the rinse liquor, there are two types of particles formed, a hydrophobic multi-lamellar vesicle and a more hydrophilic single layer micelle. Both of these particles act as carriers for the fragrance or perfume, the vesicles tend to deposit onto the fabric, whereas the micelles tend to stay in the rinse water and therefore go down the drain. The present inventors have found that with the addition of a water swellable polymer, such as BP Polymer 7050™, a polymeric thickener within the scope of WO 90/12862, or any other water swellable polymer, a shift in the equilibrium occurs causing there to be more abundant, larger and more stable vesicles, and fewer micelles and free monomer in the rinse liquor, resulting in a better delivery of fragrance to the fabric surface.

Cationic polymeric thickeners are water soluble and, if their molecular weigh is high enough, they can thicken aqueous compositions.

How the degree of cross-linking affects the rheological properties of the finished product is a complex question. Without wishing to be bound to any theory, the following is noted.

Without any cross-linking agent, the thickening capacity of this type of polymer depends on the polymer-water interactions, temperature, concentration and molecular weight.

For a given molecular weight, the viscosity of an aqueous solution increases with polymer concentration. At low concentrations, viscosity increases linearly with concentration. In case of favorable polymer-water interactions, positive deviation from linearity is observed; it is related to the second virial coefficient. At a given concentration referred to as C*, the viscosity jumps to very high values and a significant elastic component is observed. This elasticity comes from the entanglements of the polymer chains, which start to overlap in solution.

C* is a function of the molecular weight. The radius of giration of a polymer coil increases with a power of the molecular weight of between 0.5 (in a poor solvent (in theta conditions)) and 0.8 (in a very good solvent) (Flory's theory). This means that the volume of a polymer coil increases faster than the molecular weight. As a result, the concentration above which chains overlap (C*) decreases as molecular weight increases.

The way C* is affected by the cross-linking level is non-linear. The effect of a low cross-linker level is mainly chain extension. This is the case if there is up to one cross-linker molecule per polymer chain. In such a case, the effect of increasing the concentration of cross-linker is the same as increasing the molecular weight, so a higher cross-linker amount will result in more effective thickening. However, higher levels will eventually lead to swelling restriction, due to a reduction of the mean distance between cross-link nodes.

The preferred polymeric thickener preferred in accordance with the present invention has a cross-linker concentration of 80 to 150 ppm in the polymerization reaction. With this value, considerable higher than for the thickener described in WO 90/12862, a finished product is achieved which is significantly more stable on ageing and more robust than a similar product prepared with a polymeric thickener within the scope of WO 90/12862, the BP product.

Another difference is the lower stringiness of product of the invention as compared to the BP product. A lower stringiness is a great consumer advantage because the lower the stringiness, the lower the chance of messy leaks. Stinginess can be assessed by the first difference of normal stresses as measured in a steady shear Theological experiment. An aqueous solution comprising the polymeric thickener in accordance with the present invention has a lower normal stress difference than the composition containing the BP polymer under the same conditions. This is in line with the observed lower stringiness of the finished product. In this light, reference is made to FIG. 1, wherein the stringiness is plotted versus the shear rate for the BP polymer and the polymer of the present invention (SNF polymer).

Another advantage of the polymeric thickener used in accordance with the present invention is the much higher ionic regain, which is about 45–60% compared to about 15–30% for the BP polymer. (Ionic regain is measured by comparing the availability of the cationic charges before and after the polymer aqueous solution is submitted to high shear.) High ionic regain means more cationic charges which are not easily accessible. This characteristic may explain the better resistance to electrolytes exhibited by SNF polymer.

From a molecular point of view, lower normal forces and higher ionic regain may be explained by the higher degree of ramifications in the polymeric thickener used in accordance with the present invention. The cationic charges located close to the ramifications have less degrees of freedom and are consequently less accessible. Increased ramification may also explain the better physical stability of the finished product (even with low electrolyte load).

Figure 2:
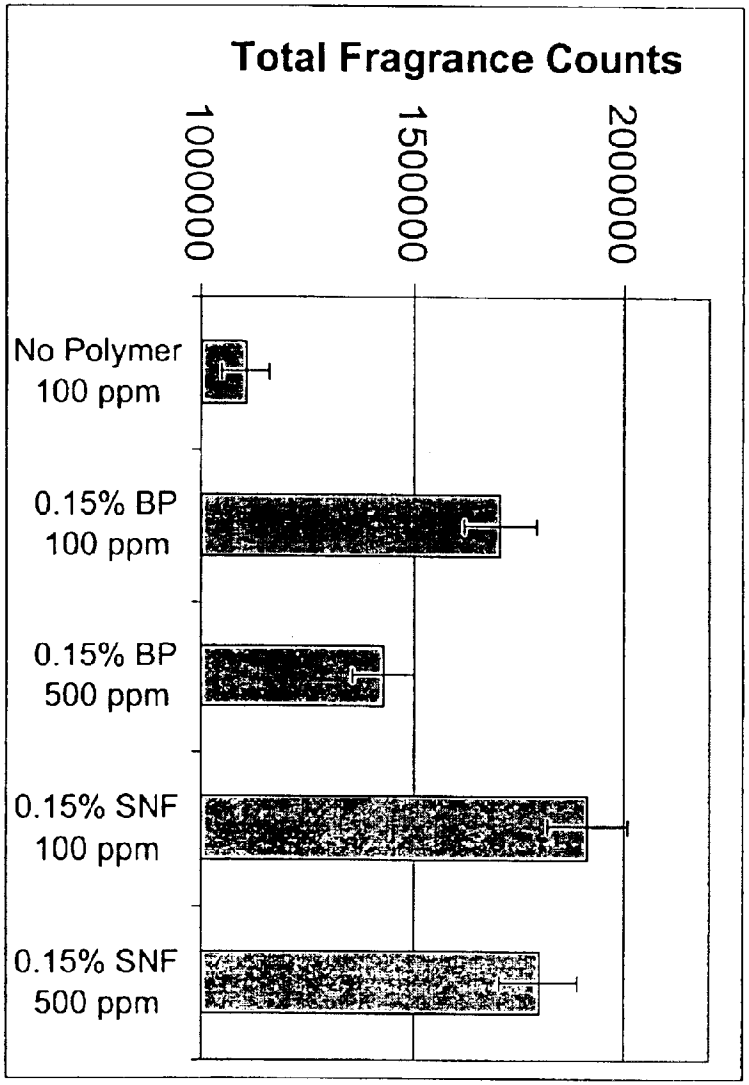
FIG. 2 describes the total fragrance counts (Y-axis) on the dry fabric (refer to Example III).

FIG. 2 illustrates the advantage of perfume or fragrance impact described above and is further described in Example III, comparing three softening compositions: the first (control) with no polymer; the second containing a BP polymer, and the third containing the polymeric thickener required by the present invention (SNF polymer). As noted in Example III, the perfume impact of a product in accordance with the present invention is 26% higher than the same product formulated with BP polymer.

Figure 3:
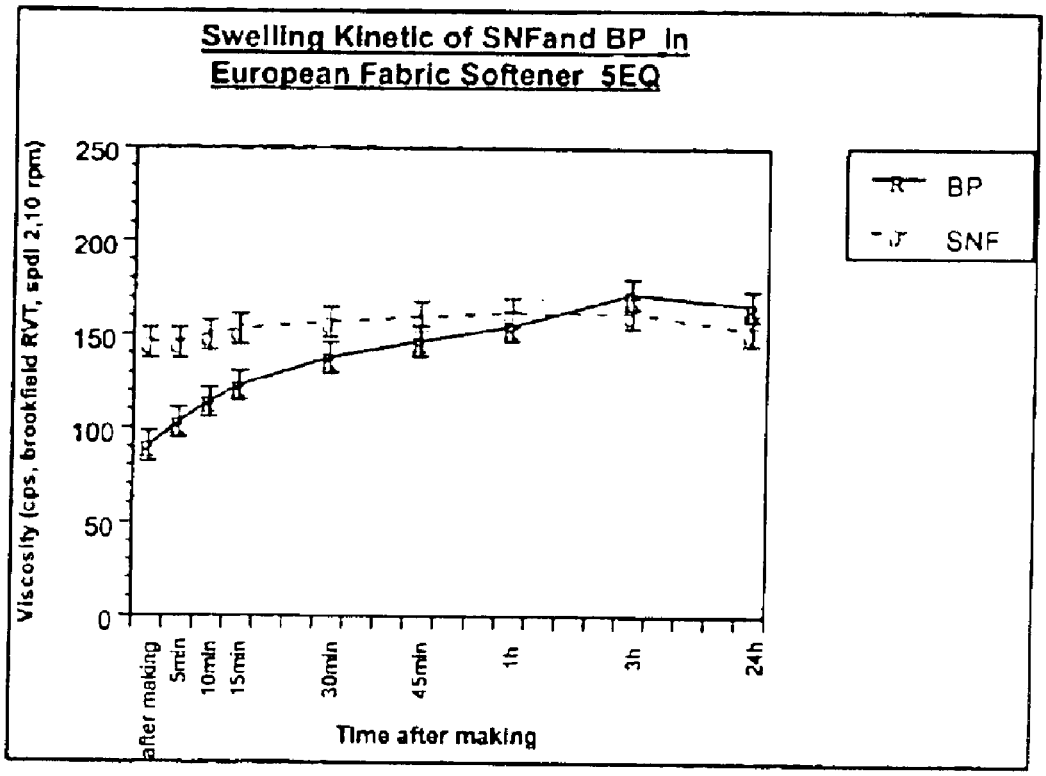
FIG. 3 describes the swelling kinetic of SNF and BP Polymers in Europe Fabric Softener.
Figure 5:
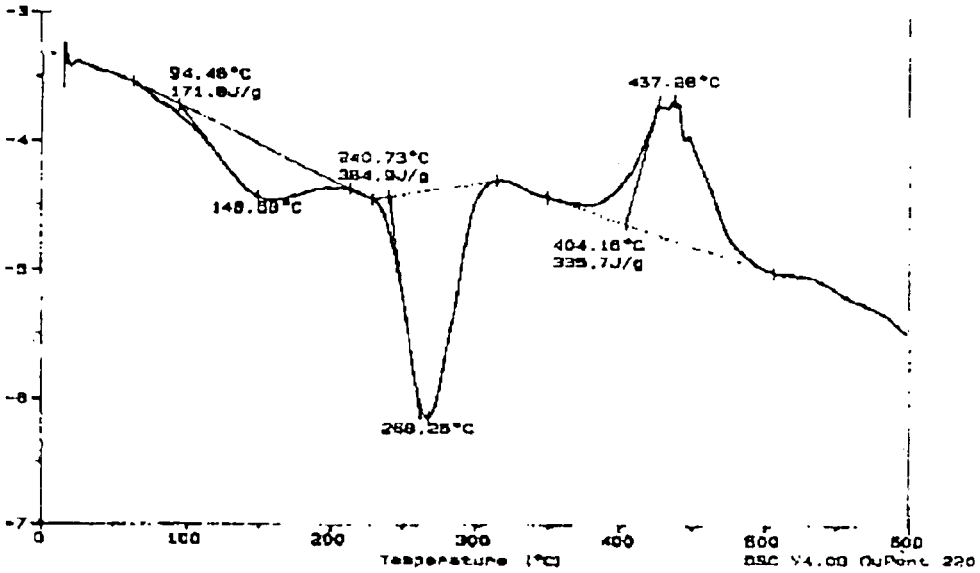
FIG. 5 describes the differential scanning calorimetry heating thermogram of SNF Polymer (Y-axis indicates heat flow watts/gram).

During fabric softener making, the dispersions of the polymeric thickener required by the present invention disperses more rapidly than BP's polymeric thickener and, as illustrated in FIG. 3, the structure reaches its equilibrium value much faster. This presents a very valuable benefit for manufacturing, as the time required for the polymer to build the structure is much shorter than with the BP polymer.

The present invention will now be further elaborated on the basis of the following non-limiting examples. In the examples, percentages are percentages active by weight, unless otherwise indicated.

EXAMPLE I

In this example, it is attempted to show the differences between a polymeric thickener within the scope of WO 90/12862 (BP 7050; the BP polymer) and a polymeric thickener required by the present invention (SNF DP/EP 2037B ex SNF, France; the SNF polymer). Both polymers are cross-linked cationic copolymers of about 20% acrylamide and about 80% trimethylammonioethylmethacrylate salt; the difference is in the amount of cross-linking agent (MBA).

Sample Preparation: Both polymers were extracted by vortexing 1 gram of polymer in 2 grams of ethyl acetate followed by centrifugation. The pellet was then re-suspended in acetone, vortexed and again centrifuged. The polymer pellet was then transferred to vial where it is washed 3 more times with acetone, allowing the polymer to settle and decanting the acetone off each time. Each polymer was then dried under nitrogen to remove any acetone.

Figure 4:
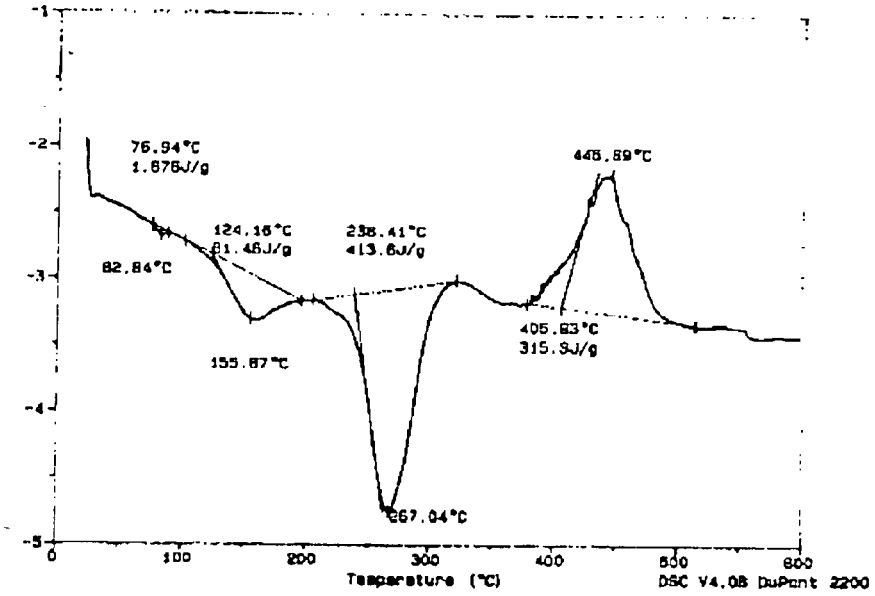
FIG. 4 describes the differential scanning calorimetry heating thermogram of BP Polymer (Y-axis indicates heat flow watts/gram).

The polymers were subjected to Differential Scanning Chromatography. The graphs obtained are shown in FIGS. 4 (BP polymer) and 5 (SNF polymer).

The BP Polymer shows endotherms at 124.16° C. (water), and 238.41° C. (melt), and an exotherm at 405.93° C. (decomposition). The Y-axis in both graphs show the heat flow (W/g; watts/gram).

The SNF Polymer shows endotherms at 94.46° C. (water), and 240.73° C. (melt), and an exotherm at 404.18° C. (decomposition).

The only significant difference observed between the two polymers is the onset of the water endotherm. This is an indication that the BP Polymer holds water more tightly than the SNF Polymer, which is showing, less tightly held, or free water.

EXAMPLE II

Rate of Dispersion of Extracted Polymers

This example is carried out to determine if the faster rate of dispersion for the SNF polymer is due to the presence of the co-surfactant or due to a difference in the polymer from BP.

Procedure: Each Polymer was suspended in hexane to create equal and uniform particle sizes in a 10% solution. 1 ml of this suspension was transferred to a vial containing 10 ml water. Vials were mixed by inverting 3 times and gellation rate was observed.

Results: The SNF polymer was completely gelled by the end of the inversions. The BP Polymer still showed large lumps of polymer. The sample was allowed to stand overnight and the gel was obtained by morning.

The data show that the SNF polymer disperses more easily than the BP Polymer in the absence of a co-surfactant. This indicates that there is an inherent difference between the two polymers other than the presence or type of co-surfactant or oil.

EXAMPLE III

Three compositions were prepared as described below which differed with respect to the thickening polymer: the first (control) contained no polymer; the second contained BP 7050; and the third contained SNF polymer. The formulas are described in the following table:

| Formula: | Percent As Active |
|---|---|
| Ester Quat | 8.0% |
| Perfume | 0.75% |
| Dequest 2000[(1)] | 0.10% |
| Lactic/Lactate Buffer | 0.063% |
| $CaCl_2$ (10% sol) | 0.050% |
| Polymer* | 0 or 0.15% |
| De-ionized $H_2O$ | to 100% |

*= BP 7050 or SNF

[(1)]Dequest 2000 is a commercial chelating compound comprising aminotri (methylenephosphonic acid). It is referred to as "Dequest" in the remaining Examples.

Analytical Data: Analysis of Fragrance Deposited onto Fabric by SPME (solid phase micro-extraction) GC/MS. The results are shown in FIG. 2.

FIG. 2 demonstrates that at 100 ppm water hardness, the softener composition with SNF polymer delivered significantly more fragrance (73% increase) on the fabric surface (dry) as compared to the control having no polymer.

FIG. 2 also demonstrates that the presence of SNF polymer resulted in significantly greater perfume delivery to the fabric surface at 100 and 500 parts per million of water hardness as compared to the perfume delivery from the same softening composition but with BP polymer in place of SNF polymer. The perfume impact when using the SNF polymer based composition was 26% higher at 500 ppm hardness than the composition formulated with BP polymer.

EXAMPLE IV

In this example the swelling kinetic of BP and SNF polymers is compared. A cross-linked polymer, when placed in a suitable solvent, imbibes the solvent and undergoes swelling to an extent determined by the nature of the polymer and the solvent. By swelling is intended the ability of the polymer to thicken the solvent whether it is water or a fabric softening composition.

De-ionized (DI) water was thickened with 0.5% (% of actives in emulsion) of BP 7050 or SNF polymer. The polymer under emulsion form was rapidly added to DI water through a syringe. The mixing speed was fixed at 250 rpm and dispersion time at 3 minutes. Swelling kinetic was then followed using a Brookfield RVT viscometer (10 rpm, spindle 2). The results are shown in FIG. 6.

Figure 6:
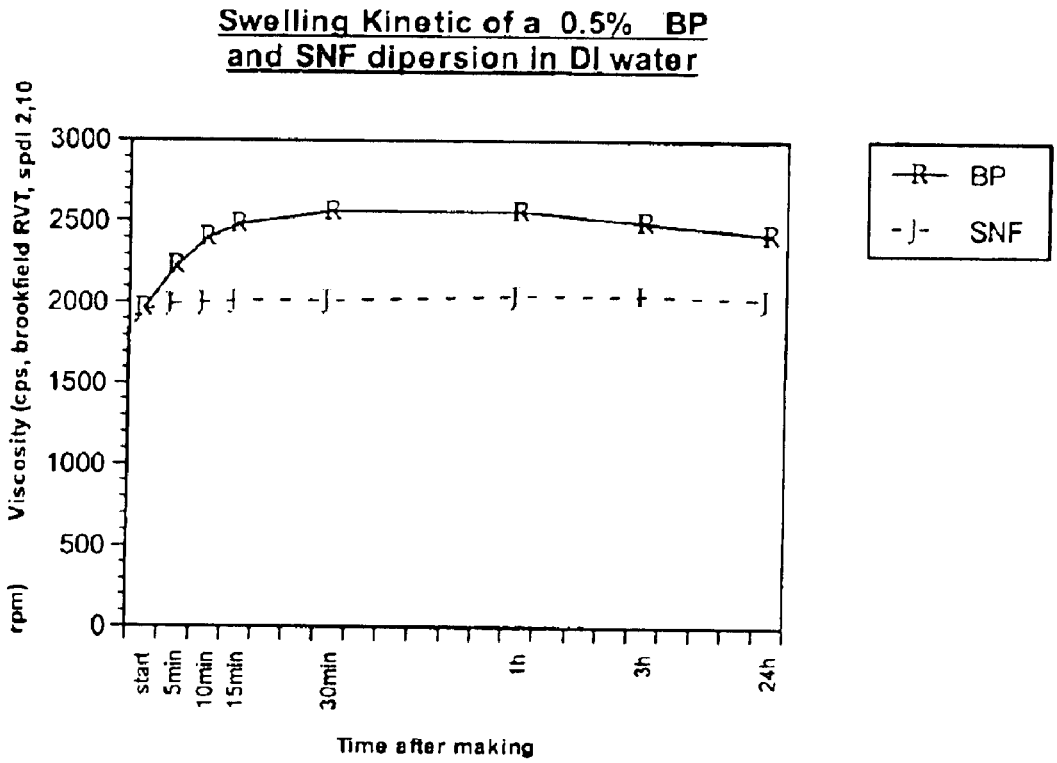
FIG. 6 describes the swelling kinetic of a 0.5% BP and 0.5% dispersion in deionised water.

As shown in FIG. 6, the final viscosity (24H) of DI water thickened with SNF polymer is obtained right after making whereas with BP 15 minutes are necessary.

EXAMPLE V

In this example the effect of the cross-linker level is shown.

Figure 7:
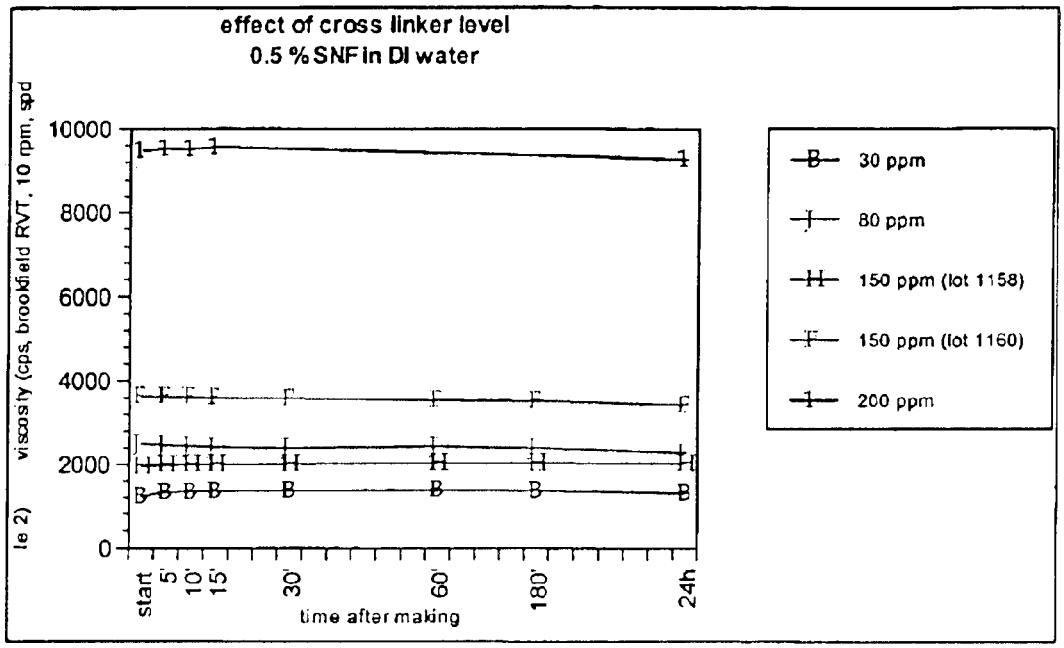
FIG. 7 describes the effect of cross-linker level on the viscosity of 0.5% dispersion of SNF polymer in deionised water.

The influence of the cross-linker level on the swelling kinetic of a 0.5% SNF dispersion in water was determined. To this end, four levels of cross-linker were tested, namely 30, 80, 150 and 200 ppm. The results are shown in FIG. 7. It is clear that the higher the cross-linker level is, the higher the viscosity of the resulting gel is. The viscosity increase versus the cross-linker level is however not linear. The swelling kinetic is independent from the cross-linker level.

EXAMPLE VI

This example shows the swelling kinetics in fabric softening compositions.

The swelling kinetic of SNF and BP polymers added to Regular Fabric softeners was studied using the European formula 5EQ as model:

| European formula | (% nominal) |
|---|---|
| Esterquat: | 3.3% |
| Fatty alcohol | 0.825% |
| Perfume: Douscent | 0.32% |
| Synperonic SA20: | 0.2% |
| Thickener | 0.115% |
| Dequest: | 0.1% |
| Dye: | 0.004% |
| KKM/lactic lactate | 0.1225% |
| DI Water | balance |

Process: 20L batch, four flat blade turbine, mixing at 500 rpm one part of water (60° C.), Perfume in AI, thickener at the end (30° C.), 15 min mixing. The results are depicted in FIG. 8.

Figure 8:
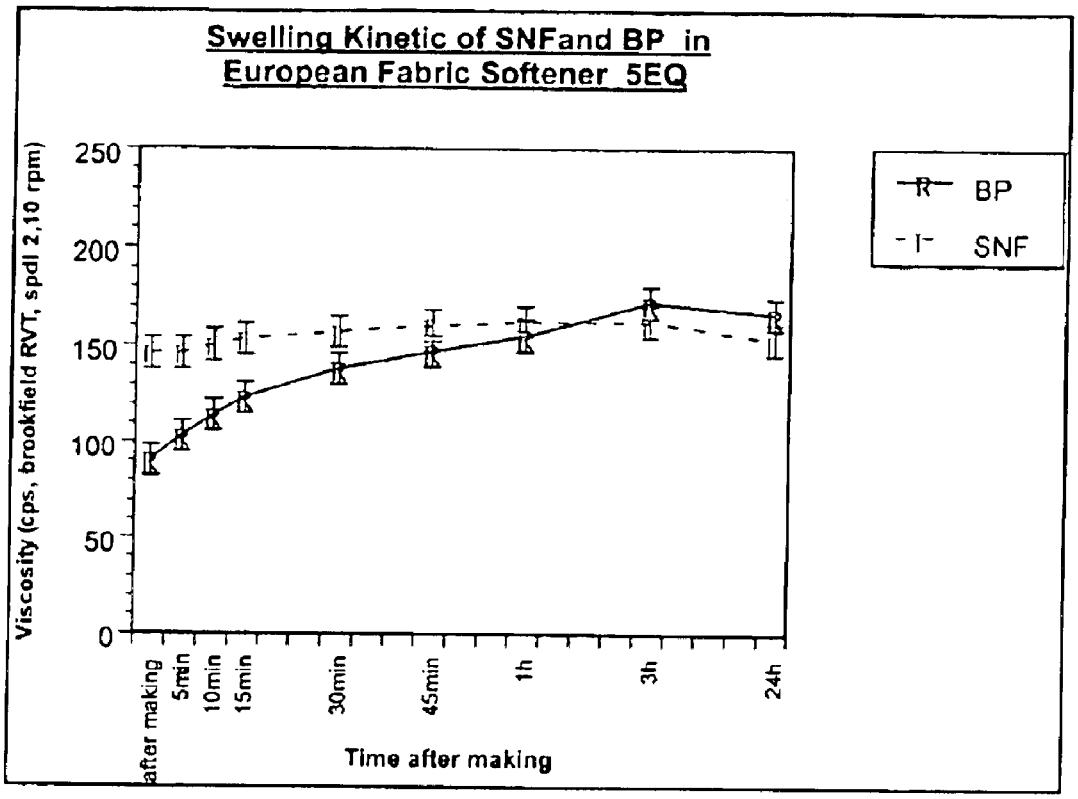
FIG. 8 describes the swelling kinetic of SNF and BP Polymers in Europe n Fabric Softener.
Figure 9A:
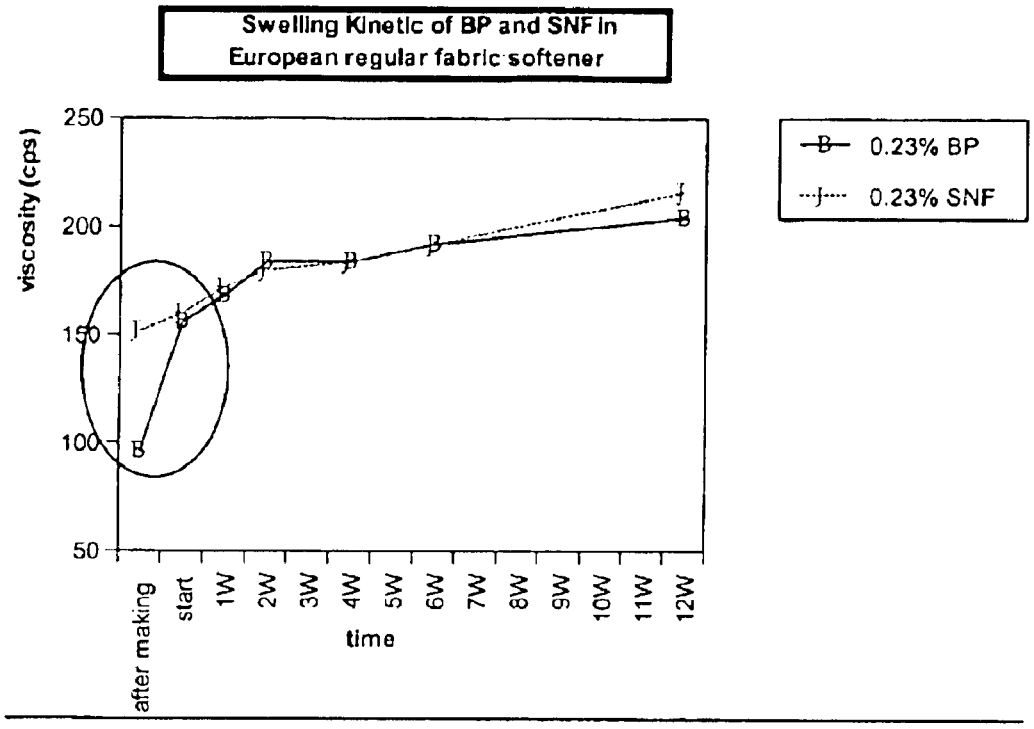
FIG. 9*a* describes the swelling kinetic of SNF and BP Polymers in Europ an Regular Fabric Softener (Formula A).
Figure 9B:
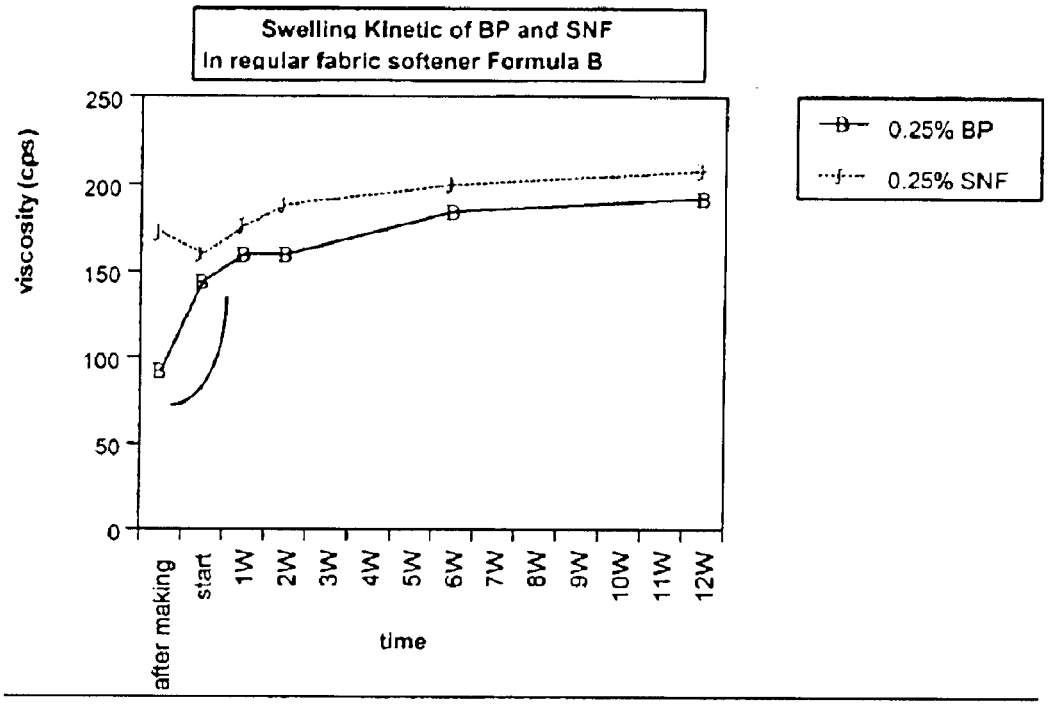
FIG. 9*b* describes the swelling kinetic of SNF and BP Polymers in Regular Fabric Softener (Formula B).
Figure 9C:
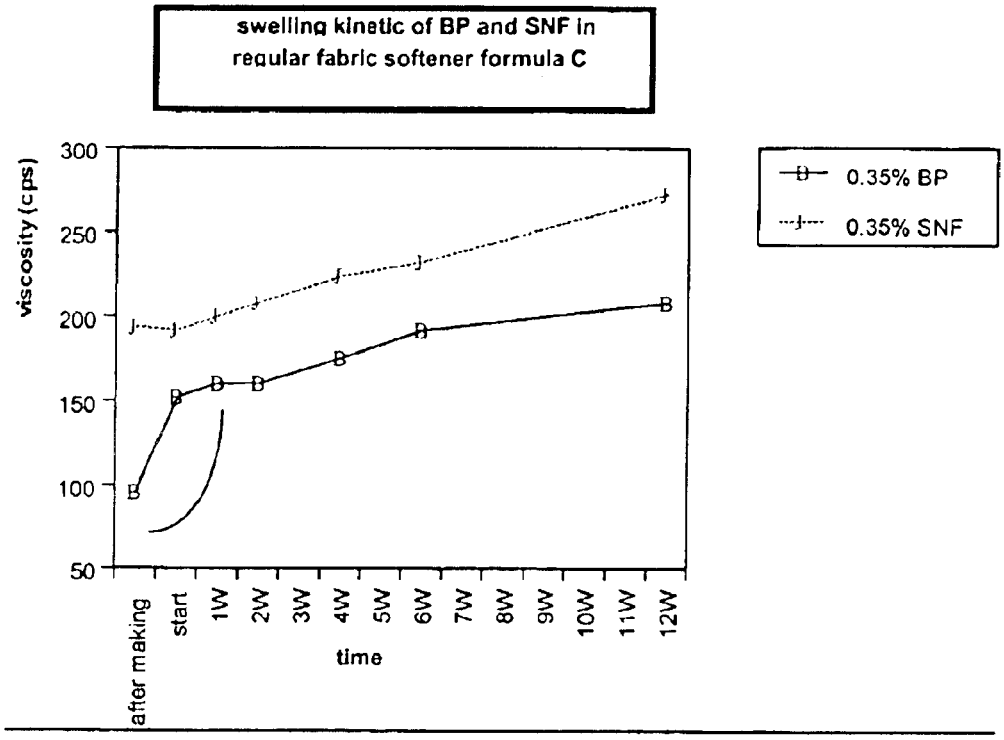
FIG. 9*c* describes the swelling kinetic of SNF and BP Polymers in Regular Fabric Softener (Formula C).
Figure 9D:
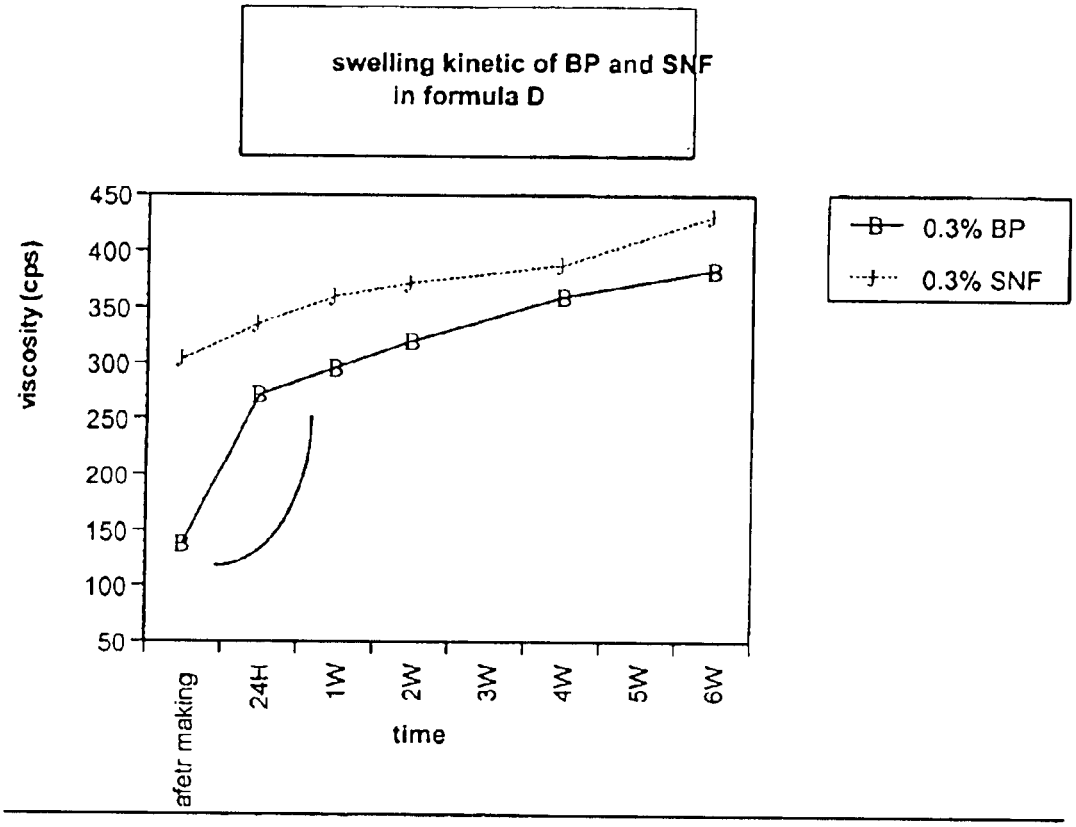
FIG. 9*d* describes the swelling kinetic of SNE and BP Polymers in Regular Fabric Softener (Formula D).
Figure 9E:
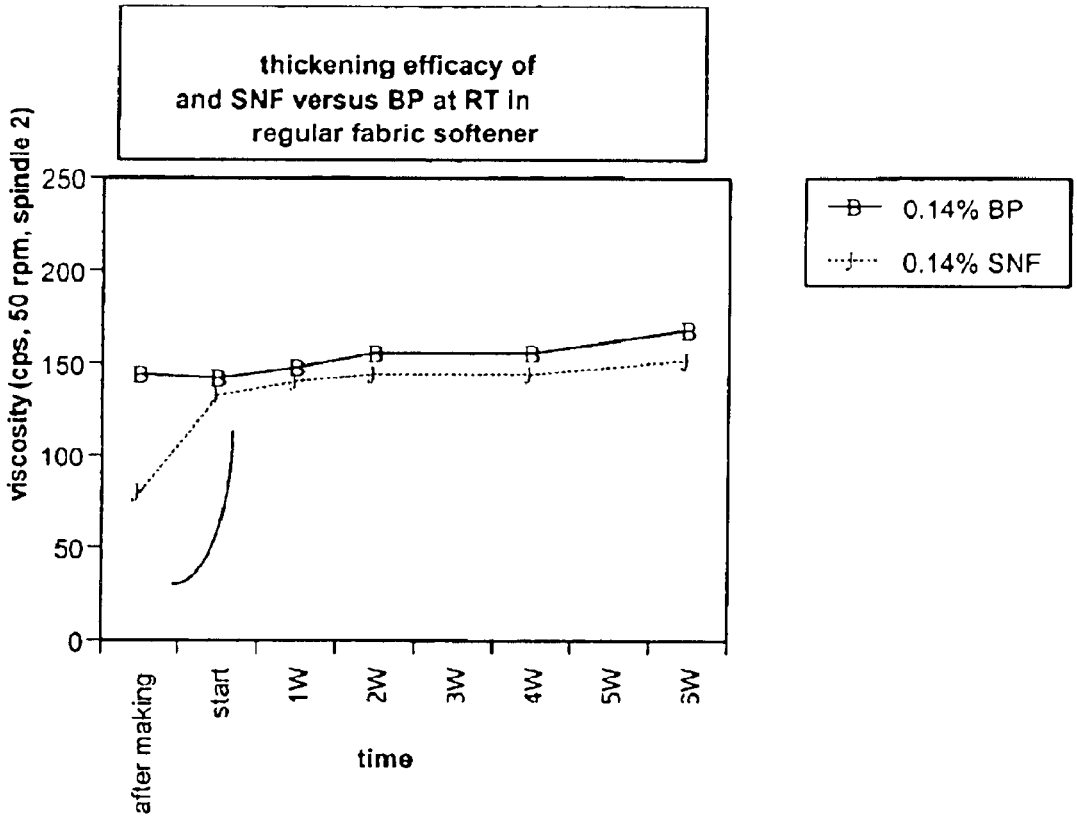
FIG. 9*e* describes the thickening efficacy of SNF and BP Polymers at room temperature in Regular Fabric Softener.

As can be seen from this FIG. 8, the final viscosity is obtained right after making for the rinse-cycle fabric softener thickened with the SNF polymer whereas wit the BP polymer 1 to 2 hours are needed. The thickening efficacy of the SNF polymer appears to be optimal in the range of 80-150 ppm cross-linker. The viscosity decreases outside this range.

EXAMPLE VII

The previous example is repeated, but now using continuous and batch pilot scale equipment. In the batch process the swelling kinetic of SNF and BP polymers has been checked in 5 formulas of reference:

| | (% nominal) |
|---|---|
| FORMULA A | |
| Esterquat—90%: | 3.3 |
| Fatty alcohol C16–C18 | 0.825 |
| Perfume: Douscent 653 NMR | 0.32 |
| Synperonic C13–15 fatty alcohol EO 20:1 | 0.2 |
| Thickener | 0.115 |
| Dequest | 0.1 |
| Dye Royal blue | 0.004 |
| KKM 446 | 0.06 |
| lactic lactate buffer solution | 0.0625 |
| Demineralized Water | balance to 100 |
| FORMULA B | |
| Esterquat—90%: | 4 |
| Fatty alcohol C16–C18 | 0.6 |
| Perfume: Douscent 653 NMR | 0.32 |
| Synperonic C13–15 fatty alcohol EO 20:1 | 0.2 |
| Thickener | 0.125 |
| Dequest | 0.1 |
| Dye Royal blue | 0.004 |
| KKM 446 | 0.06 |
| lactic lactate buffer solution | 0.0625 |
| Demineralized Water | balance to 100 |
| FORMULA C | |
| Esterquat—90%: | 4.5 |
| Perfume: Douscent 653 NMR | 0.32 |
| Synperonic C13–15 fatty alcohol EO 20:1 | 0.2 |
| Thickener | 0.175 |
| Dequest | 0.1 |
| Dye Royal blue | 0.004 |
| KKM 446 | 0.06 |
| lactic lactate buffer solution | 0.0625 |
| Demineralized Water | balance to 100 |
| FORMULA D | |
| Esterquat—90%: | 7.8 |
| Perfume: Douscent 653 NMR | 0.32 |
| Synperonic C13–15 fatty alcohol EO 20:1 | 0.2 |
| Thickener | 0.15 |
| Dequest | 0.1 |
| Dye Royal blue | 0.004 |
| KKM 446 | 0.06 |
| lactic lactate buffer solution | 0.0625 |
| Demineralized Water | balance to 100 |
| FORMULA E | |
| Esterquat—90%: | 3.6 |
| Perfume: Larian M | 0.2 |
| Synperonic C13–15 fatty alcohol EO 20:1 | 0.1 |
| Thickener | 0.14 |
| Dequest | 0.1 |
| Dye Royal blue | 0.004 |
| KKM 446 | 0.06 |
| lactic lactate buffer solution | 0.0625 |
| Demineralized Water | balance to 100 |

The results for the FORMULAE A–E are depicted in FIGS. 9*a*–9*e*, respectively. Whatever the formula composition, i.e. the actives level (esterquat and fatty alcohol), the swelling kinetic of the SNF polymer is faster than for the BP polymer. Final viscosity is reached right after making for SNF whereas for BP a delay is required.

EXAMPLE VIII

FORMULA A was used in this example. The mixing devices and emulsifier level have been varied as follows:

VIIIa: high shear (mixing valve +centrifugal pump), 0.2% of SA20 emulsifier

VIIIb: low shear (mixing valve), 0.2% of SA20 emulsifier

VIIc: low shear (mixing valve), 0.3% of SA20 emulsifier

Figure 10A:
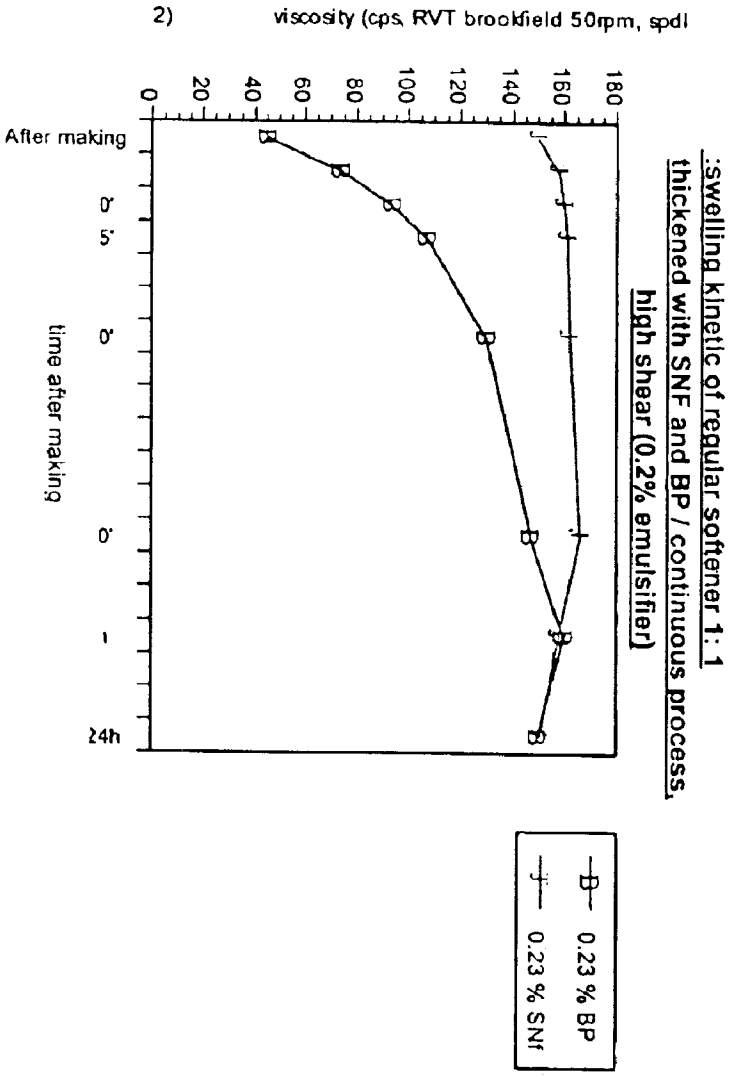
FIG. 10*a* describes the swelling kinetic of regular softener thickened with SNF and BP Polymers in a continuous process; high shear (0.2% emulsifier).
Figure 10B:
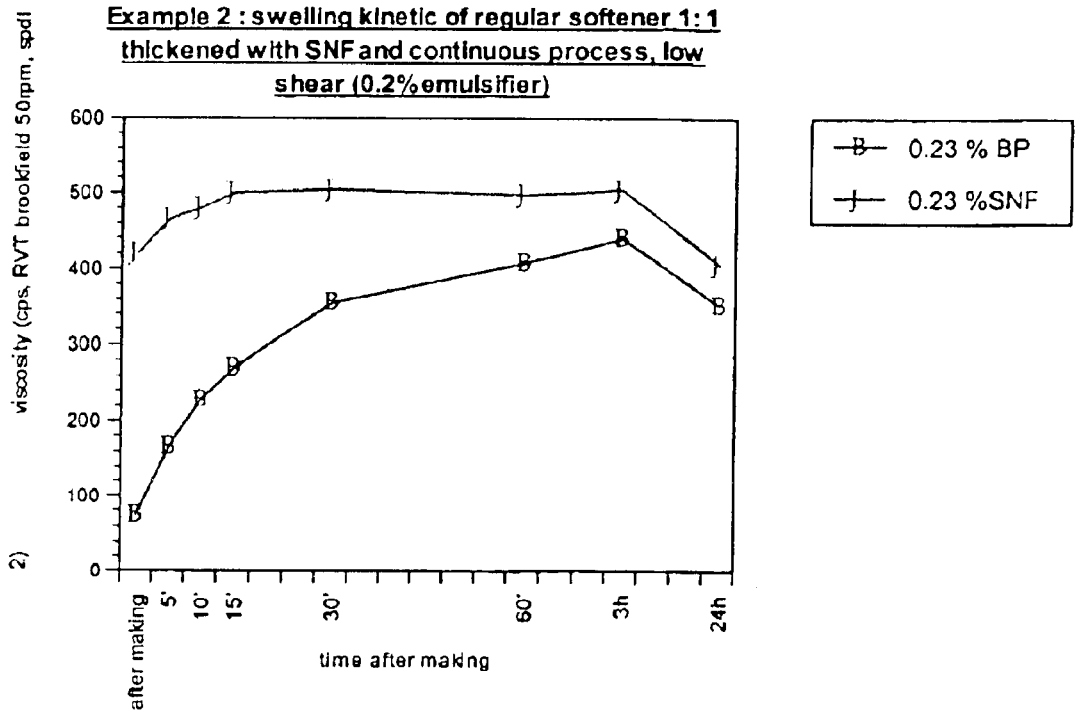
FIG. 10*b* describes the swelling kinetic of regular softener thickened with SNF and BP Polymers in a continuous process; low shear (0.2% emulsifier).
Figure 10C:
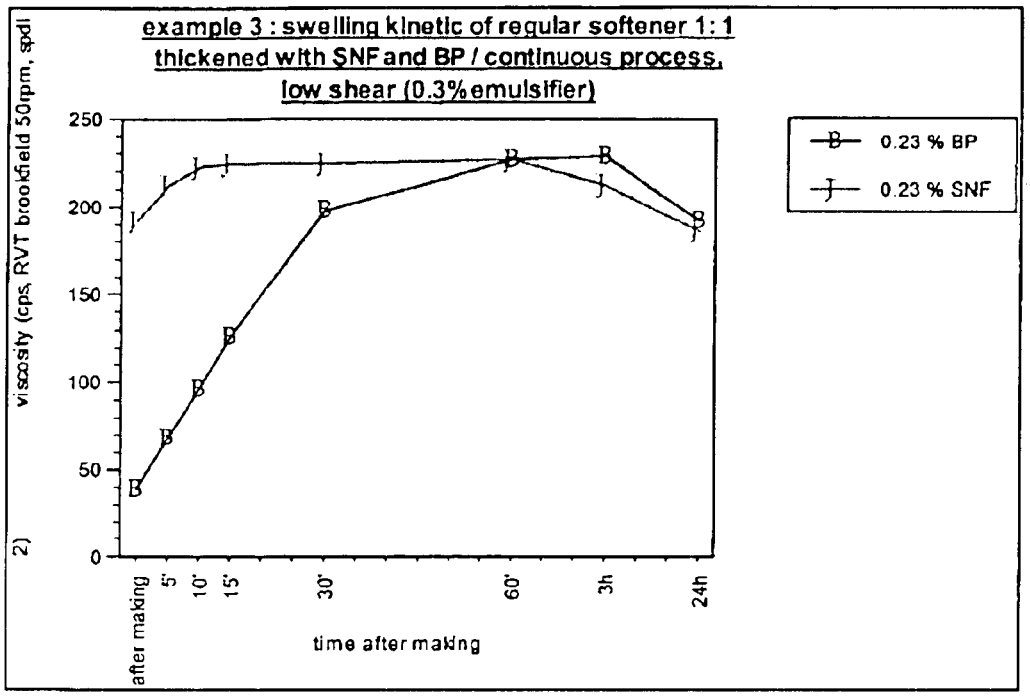
FIG. 10*c* describes the swelling kinetic of regular softener thickened with SNF and BP Polymers in a continuous process; low shear (0.3% emulsifier).

The results are shown in FIGS. 10*a–c*. Just like in the batch processes, the swelling kinetic of the product of the invention is considerably quicker than for the product based on the BP thickener. No delay is necessary to obtain the final viscosity with SNF, whereas with the BP polymer 30 minutes up to 1 hour are needed. Moreover, the SNF swelling kinetics seem independent from the shear level and the emulsifier level.

EXAMPLE IX

Figure 11:
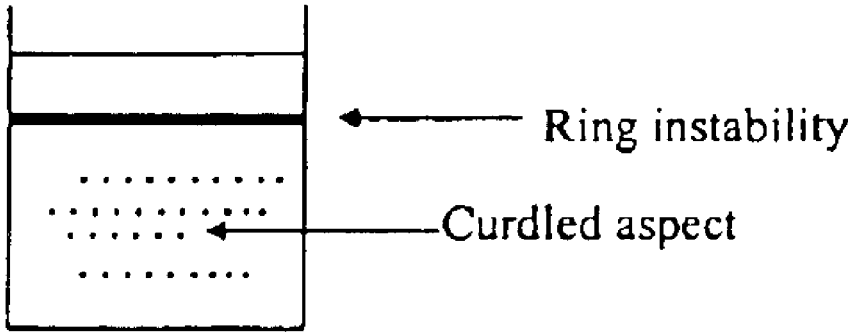
FIG. 11describes the appearance of a ring or curdled aspect (Example 1X).

Formula A was tested on the stability. The formula with the BP polymer exhibits distinct marks of instabilities after 6 weeks of aging, whereas the SNF polymer formula has an almost perfect stability at all aging temperatures: 4° C., RT, 35° C. and 43° C. By distinct marks of instabilities are meant: an apparition of a dark ring; and possible curdled aspect or evidence of starting flocculation phenomena. See in this respect FIG. 11.

EXAMPLE X

In this example the stability to electrolytes is studied. In some fabric softening formulations, salt addition is needed to adjust the final viscosity of the finished product. Thus, from a manufacturing point of view, the sensitivity of Rinse Cycle Fabric Softeners to electrolytes is of great interest. In this light, it has been shown that fabric softening compositions with SNF polymers are significantly less sensitive to electrolytes than those with BP polymer. This has been illustrated on the basis of Formula D with 0.01 to 0.03 wt. % of $CaCl_2$. The electrolyte was post-added to the finished product.

After six weeks of aging the SNF thickened composition has a very good stability, whereas in the composition containing the BP polymer high instabilities are observed. The instabilities are characterized by the presence of multi rings and thin curdles at RT, 35° C. and 4° C. At 43° C. phase separation occurs.

EXAMPLE XI

In the present example the stability toward shear is tested. The formulas with SNF polymer are less sensitive to shear than those with BP polymer.

Sensitivity to shear of fabric softeners thickened with SNF and BP polymers was studied using formula A. Formulas were prepared following a batch process at pilot scale. SNF and BP polymers were added at 0.23% (w %).

After making, the formulas were submitted to high shear using a centrifugal pump (3 bars). Stability was then compared upon aging.

After 12 weeks of aging the BP containing composition exhibits instabilities as ring and curdled aspect at all aging temperatures; whereas the SNF containing compositions are perfectly stable whatever the temperature.

We claim:

1. A fabric softening composition comprising:

(a) from 0.01% to 35%, by weight, of a cationic softener wherein said cationic softener is an esterquat which is a biodegradable fatty ester quaternary ammonium compound having the formula:

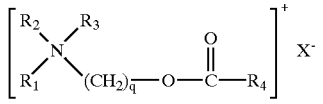

wherein R4 represents an aliphatic hydrocarbon group having from 8 to 22 carbon atoms, $R_2$ and $R_3$ represent $(CH_2)_{s\text{-}R5}$ where $R_5$ represents an alkoxy carbonyl group containing from 8 to 22 carbon atoms, benzyl, phenyl, (C1–C4)-alkyl substituted phenyl 1, OH or H; R1 represents $(CH_2)_t$ $R_6$ where $R_6$ represents benzyl, phenyl, (C1–C4)-alky substituted phenyl, OH or H; q, s, and t, each independently, represent an integer from 1 to 3; and $X^-$ is a softener compatible anion;

(b) at least 0.00 1%, by weight, of a water soluble cross-linked cationic polymer derived from the polymerization of from 5 to 100 mole percent of cationic vinyl addition monomer, from 0 to 95 mole percent of acrylamide, and from 70 to 300 ppm of a difunctional vinyl addition monomer cross-linking agent; and (c) a perfume.

2. The fabric softening composition of claim 1, wherein said cationic polymer is derived from said polymerization using 75 to 200 ppm of said cross-linking agent.

3. The fabric softening composition of claim 2, wherein said cationic polymer is derived from said polymerization using 80 to 150 ppm of said cross-linking agent.

4. The fabric softening composition of claim 1, wherein said cationic polymer is a cross-linked cationic vinyl polymer.

5. The fabric softening composition of claim 4, wherein said polymer comprises a quaternary ammonium salt of an acrylate or methacrylate.

6. The fabric softening composition of claim 5, wherein said polymer comprises a quaternary ammonium salt of dimethyl aminoethyl methacrylate.

7. The fabric softening composition of claim 1, further including a chelating compounds selected from the group consisting of amino carboxylic acid compounds, organo aminophosphonic acid compounds and mixtures thereof.

* * * * *